US005711171A

United States Patent [19]

Uhlin

[11] Patent Number: 5,711,171

[45] Date of Patent: Jan. 27, 1998

[54] WASHING MACHINE

[75] Inventor: Göran Uhlin, Lagan, Sweden

[73] Assignee: Aktiebolaget Electrolux, Stockholm, Sweden

[21] Appl. No.: 585,022

[22] Filed: Jan. 11, 1996

[30] Foreign Application Priority Data

Jan. 31, 1995 [SE] Sweden ..... 9500339

[51] Int. Cl.[6] ..... D06F 37/22

[52] U.S. Cl. ..... 68/4; 68/23.1; 68/24; 68/140

[58] Field of Search ..... 68/23.1, 4, 24, 68/140; 210/144, 364; 34/596, 601

[56] References Cited

U.S. PATENT DOCUMENTS

| | | | |
|---|---|---|---|
| 3,098,372 | 7/1963 | Bochan | 68/23.1 |
| 3,226,960 | 1/1966 | Mellinger | 68/23.1 |
| 3,509,742 | 5/1970 | Bauer | 68/23.1 |
| 3,570,273 | 3/1971 | Hertig | 68/23.1 |
| 3,854,308 | 12/1974 | Czech et al. | 68/23.3 |

FOREIGN PATENT DOCUMENTS

| | | | |
|---|---|---|---|
| 1329009 | 4/1963 | France | 68/23.1 |
| 1377563 | 9/1969 | France | 68/23.1 |
| 2387310 | 11/1978 | France . | |
| 1760826 | 12/1971 | Germany . | |
| 609334 | 9/1960 | Italy | 68/140 |
| 1179018 | 1/1970 | United Kingdom | 68/23.1 |
| 1243642 | 8/1971 | United Kingdom . | |
| 1598210 | 9/1981 | United Kingdom . | |

*Primary Examiner*—Philip R. Coe

*Attorney, Agent, or Firm*—Pearne, Gordon, McCoy & Granger LLP

[57] ABSTRACT

A washing machine, having a frame (11) that supports the main functional components of the washing machine, such as a tub (12) including a rotatable drum (13) for the laundry, motor drive means (14) for rotation of the drum (12), a base plate (21) supporting the frame (11) and an outer machine housing (22) fixed to the base plate (21). The base plate (21) and the frame (11), respectively, are of a design such that the two parts can be connected to one another either fixedly, for forming of a machine adapted to be fixedly supported, or in a resilient manner, for forming a free-swinging machine in which, in principle, the frame (11) can move freely relative to the base plate (21) and the outer housing (22).

15 Claims, 2 Drawing Sheets

WASHING MACHINE

BACKGROUND OF THE INVENTION

The present invention relates to washing machines, in particular a washing machine of a design permitting the machine to be adapted, with only slight modification, to be supported either fixedly or as a free-swinging machine. Fixed support is meant to describe securing of the machine to a foundation or the like being part of the floor of the room where the machine is placed. Free-swinging support is meant to describe a mounting where the machine stands freely on the floor and the unit of the machine supporting the rotating washing drum is resiliently connected to a base plate of the machine such that, in principal, the unit can move relatively freely with respect to the base plate.

Particularly in connection with washing machines for commersial use, such as in laundries, laundrymats, or in washhouses, fixed mounting and free-swinging mounting are used alternately. Usually, machines intended for one supporting system have been manufactured separately from machines intended for the other supporting system. It is an obvious disadvantage to manufacture two completely separate series or lines of washing machines which are identical except for the supporting parts.

SUMMARY OF THE INVENTION

An object of the invention is to eliminate the drawback referred to and to provide a washing machine which with only minor modifications can be adapted to either of the two supporting systems.

BRIEF DESCRIPTION OF THE DRAWINGS

The invention will now be described more in detail in connection with an embodiment and with reference to the accompanying drawings, in which.

DETAILED DESCRIPTION OF THE PREFERRED EMBODIMENTS

Figure 1:
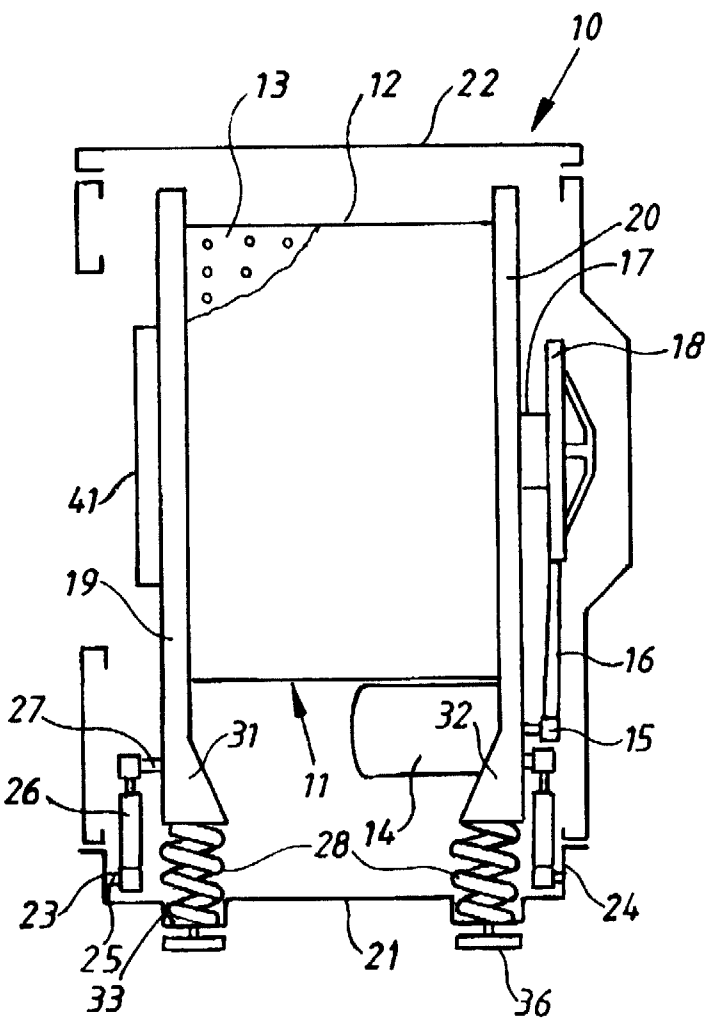
FIG. 1 schematically shows a lateral cross-section of a washing machine adapted for a free-swinging support mode.

FIG. 1 shows an embodiment of a washing machine 10 according to the invention adapted to be free-swingingly supported. The washing machine is shown schematically only and comprises a frame 11 adapted to support most of the functional components of the machine, such as a tub 12 with a washing drum 13 rotatably mounted therein and, further, a driving arrangement for rotating the drum comprising an electric motor 14 provided with a motor pulley 15, a belt 16 and a pulley 18 provided on the driving shaft 17 of the drum. The frame 11 comprises a front gable 19 and a rear gable 20. The front gable has an opening, closed by a door 41, permitting access to the interior of the drum. The two gables and the tub 12 are joined to form a unit.

The frame is adapted to be mounted on a base plate 21 also supporting a housing 22 for the machine. At the front and back the base plate has stand-up edges 23, 24 provided with fasteners 25 for the lower ends of shock absorbers 26 the upper ends of which being adapted to be connected to brackets 27 provided on the frame. In the embodiment shown four such shock absorbers are provided. The frame rests on coil springs 28 the upper ends of which bear against surfaces 29 provided in recesses 30 in the lower edge of the respective gable 19, 20. The thickness of the gables is smaller than the diameter of the coil springs and, for the purpose of achieving a more compact design, the coil springs have been disposed such that the parts thereof directed in the forward and backward direction, respectively, are flush with the corresponding surfaces of the gables 19, 20. In order to provide supporting surfaces on the frame corresponding to the diameter of the coil springs the respective gable 19, 20 is provided with reinforcing portions 31, 32 directed inwards.

Figure 2:
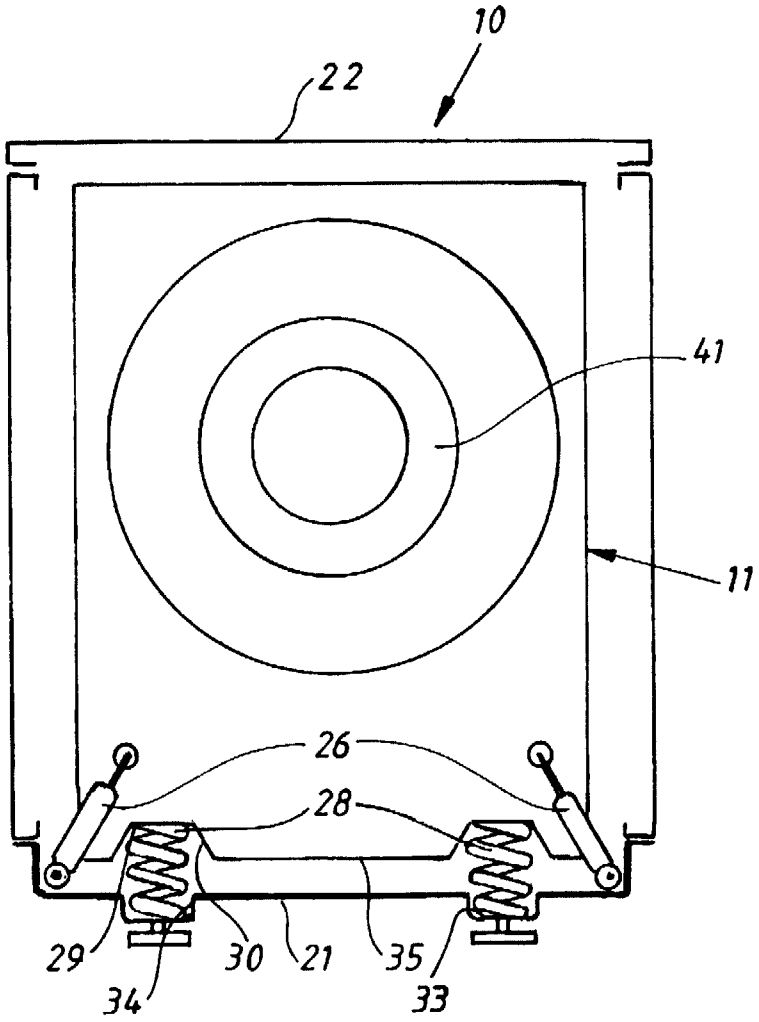
FIG. 2 schematically shows a front cross-section of the washing machine of FIG. 1.

For supporting of the opposite ends of the coil springs 28, the base plate 21 is provided with recessed surfaces 33 wherein the end of the spring 28 is kept in place by means of the vertical side surfaces 34 defining the recessed surface 33. The portions of the side surfaces 34 directed in a forward direction and bordering on the surfaces 33 disposed at the front of the machine are flush with the front surface of the front gable 19. Correspondingly, the portions of the side surfaces 34 directed backwards and bordering on the surfaces 33 provided at the back of the machine are flush with the rear surface of the rear gable 20. The base plate 21 is shaped such that in the area between the front surface of the front gable 19 and the stand-up edge 23 a space is created for the shock absorbers 26. Correspondingly, a similar space is created for the shock absorbers in the area between the rear surface of the rear gable 20 and the stand-up edge 24. As is best shown in FIG. 2 the respective gable 19, 20 is provided, at the bottom, with an elongate plane supporting surface 35 in which the recesses 30 are formed. For the mounting of the machine on uneven floors feet 36 are provided which can be adjusted vertically. Suitably, the foot 36 comprises a bolt or the like where the bolt head has been replaced by a foot plate. The adjustable foot is mounted by being entered in a correspondingly tapped hole in the base plate 21. The foot 36 can be locked in the adjusted position by a lock nut, not shown.

Figure 4:
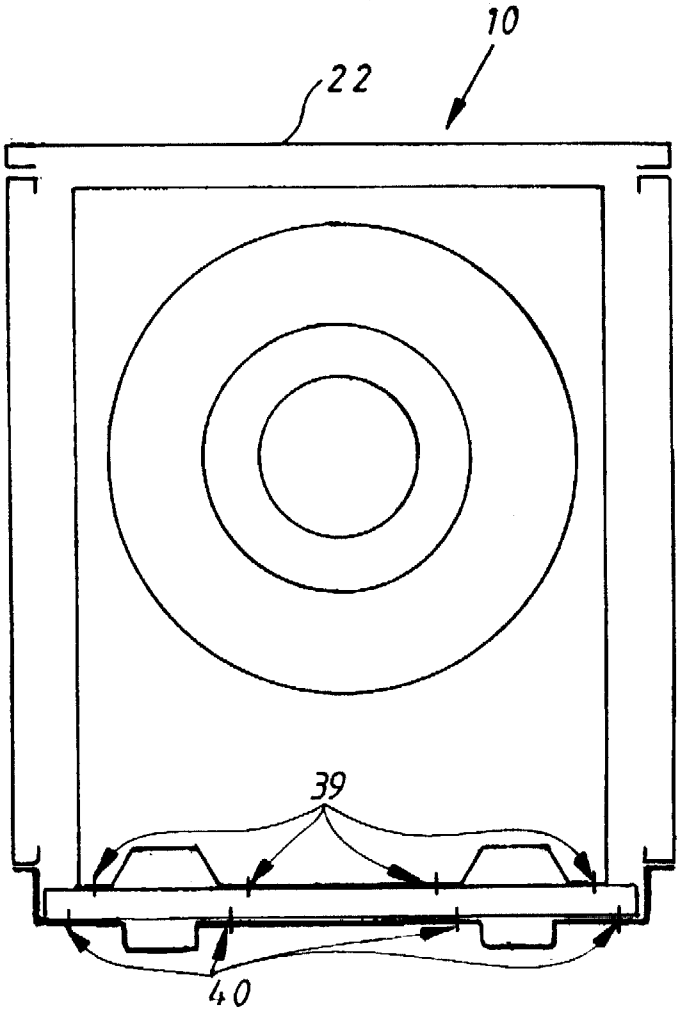
FIG. 4 shows a front cross-section of the washing machine of FIG. 3.
Figure 3:
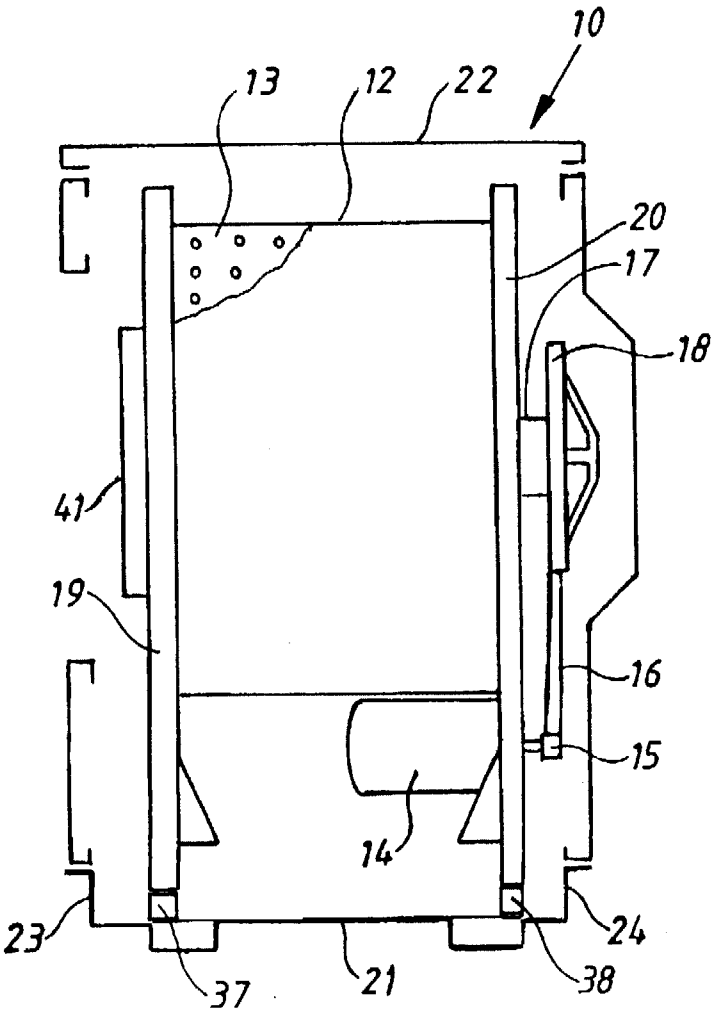
FIG. 3 schematically shows a lateral cross-section of a washing machine adapted for a fixed support mode.

In FIGS. 3 and 4 there is shown an embodiment of the invention adapted to be fixedly supported, i.e. the machine is intended, by means of bolts or the like, to be secured to a foundation being an integral part of the supporting base on which the machine has been placed. The machine is identical, in all essentials, to the embodiment shown in FIGS. 1 and 2 and for identical details the same reference numerals have been used as in FIGS. 1 and 2. The frame 11 and the base plate 21 are identical whereas in this embodiment the springs and the shock absorbers are omitted. In order to interconnect the frame 11 and the base plate 21 elongated connecting members in the form of square tubes 37, 38 are disposed under the respective front and rear gable 19, 20. The square tubes 37, 38 extend along the full width of the respective gable 19, 20 and slightly beyond the same (FIG. 4). The square tubes 37, 38 are connected to the gable 19, 20 by means of screw joints 39 in a first row and to the base plate 21 by means of screw joints 40 in a second row. The screw joints of the first row and the screw joints of the second row are situated in different vertical planes. In this embodiment the adjustable feet 36 have been omitted and the machine is secured to a foundation or supporting surface by means of bolts being imbedded in the foundation and inserted in corresponding holes in the base plate 21. Suitable nuts and eventual washers complete the bolt joints securing the base plate 21 to the foundation (not shown).

As appears from the description given above it is possible during the manufacture of machines to be fixedly mounted and to be free-swingingly mounted, respectively, to make in advance the frame 11 with its functional components, the housing 22 and the base plate 21. Those components which are specific for the fixed support and for the free-swinging support, respectively, such as springs 28 and shock absorbers 26 as well as the square tubes 37 and 38 can be provided separately. This means that the final assembly of machines adapted for one or the other of the two supporting modes can take place alternately on the same manufacturing line to which a minimum number of premade parts need to be supplied. In this way the invention offers a more rational and simplified manufacture of the machines referred to.

I claim:

1. Washing machine comprising a frame (11), a base plate (21) supporting the frame (11) and an outer machine housing (22) fixed to the base plate (21), said base plate (21) having recessed portions (33) and said frame supporting main functional components of the washing machine, said functional components comprising a tub (12) including a rotatable drum (13) for laundry and motor drive means (14) for rotating the drum (13), said washing machine further comprising supports between the base plate (21) and the frame (11) supporting the functional components and selected from the group of free-swinging supports having spring means (28) extending into said recessed portions (33) and motion damping means (26) and fixed-mount supports having elongated fitting means (37, 38) extending over said recessed portions (33).

2. Washing machine according to claim 1, wherein said supports are free-swinging supports, said spring means are coil springs, and said motion damping means are shock absorbers, lower ends of the coil springs (28) extending into said recessed portions (33) of said base plate, upper ends of said coil springs (28) extending into correspondingly recessed portions (29) provided in the frame (11) at its lower end, the base plate (21) being provided with fasteners (25) connected to ends of said shock absorbers (26), opposite ends of said shock absorbers being connected to corresponding fasteners (27) provided on the frame (11) at the lower end thereof.

3. Washing machine according to claim 2, wherein the frame (11) comprises a front gable (19) having an access opening to the drum (13) and a rear gable (20), each of the respective gables (19, 20) having, at its lower end, an elongate supporting surface (35) extending along a full width of the gable and in which recesses (30) are provided, the recesses are directed upwards and form the recessed portions (29) in the frame that receive the upper ends of the coil springs.

4. Washing machine according to claim 3, wherein the base plate (21) is provided with front and rear stand-up edges (23, 24), the two gables (19, 20) being disposed at a distance from the front (23) and rear edges (24), respectively, on the base plate (21) such that space is created for receipt of the shock absorbers (26) between the respective gables (19, 20) and the corresponding edges (23, 24) on the base plate (21).

5. Washing machine according to claim 4, wherein the fasteners (25) for the shock absorbers (26) on the base plate (21) are disposed on the front (23) and rear (24) stand-up edges.

6. Washing machine according to any one of claims 3–5, wherein the gables (19, 20) are disposed such that surfaces of the gables directed forwards and backwards, respectively, are situated flush with the corresponding front and rear side edges (34) for the recessed portions (33) in the base plate (21) receiving the lower ends of the coil springs, and the gables (19, 20) have a thickness which is smaller than the diameter of the coil springs and reinforcing portions (31, 32) directed inwards in the machine and forming engagement surfaces (29) for the upper ends of the coil springs.

7. Washing machine according to claim 1, wherein said supports are fixed-mount supports, said elongated fitting means (37, 38) are interposed between surfaces (35) on the lower part of the frame (11) and corresponding surfaces on the base plate (21), and fastening means (39, 40) are provided for fixedly connecting the frame (11) to the base plate (21) via the elongated fitting means (37, 38).

8. Washing machine according to claim 7, wherein the frame (11) comprises a front gable (19) having an access opening to the drum (13) and a rear gable 20, and the elongated fitting means (37, 38) have the shape of a square tube, a side of said tube having a width essentially corresponding to the thickness of each gable (19, 20).

9. Washing machine according to claim 8, wherein in the fastening means (39, 40) are screws which, in a first row, interconnect the square tube (37, 38) and the frame (11) and, in a second row, interconnect the square tube (37, 38) and the base plate (21), the screws in the first row being situated in vertical planes which are different from the corresponding planes of the screws (40) in the second row.

10. Washing machine according to claim 1, wherein said recessed portions (33) are generally cylindrically shaped.

11. Washing machine comprising a frame (11), a base plate (21) supporting the frame (11) and an outer machine housing (22) fixed to the base plate (21), said base plate (21) having recessed portions (33) and said frame supporting main functional components of the washing machine, said functional components comprising a tub (12) including a rotatable drum (13) for laundry and motor drive means (14) for rotating the drum (13), the base plate (21) and the frame (11), respectively, having portions (33; 29) adapted to be connected to one another by coil springs (28) with lower ends extending into said recessed portions (33) of said base plate (21) and being provided with fastening means (25; 27) for shock absorbers (26) adapted to form, with the coil springs (28), a free-swinging support of the main functional components, upper ends of said coil springs (28) extending into correspondingly recessed portions (29) provided in the frame (11) at its lower end, the base plate (21) being provided with fasteners (25) connected to ends of said shock absorbers (26), opposite ends of said shock absorbers being connected to corresponding fasteners (27) provided on the frame (11) at the lower end thereof.

12. Washing machine according to claim 11, wherein the frame (11) comprises a front gable (19) having an access opening to the drum (13) and a rear gable (20), each of the respective gables (19, 20) having, at its lower end, an elongate supporting surface (35) extending along a full width of the gable and in which recesses (30) are provided, the recesses are directed upwards and form the recessed portions (29) of the frame that receive the upper ends of the coil springs.

13. Washing machine according to claim 12, wherein the base plate (21) is provided with front and rear stand-up edges (23, 24), the two gables (19, 20) being disposed at a distance from the front (23) and rear edges (24), respectively, on the base plate (21) such that space is created for receipt of the shock absorbers (26) between the respective gables (19, 20) and the corresponding edges (23, 24) on the base plate (21).

14. Washing machine according to claim 13, wherein the fasteners (25) for the shock absorbers (26) on the base plate (21) are disposed on the front (23) and rear (24) stand-up edges.

15. Washing machine according to any one of claims 12–14, wherein the gables (19, 20) are disposed such that surfaces of the gables directed forwards and backwards, respectively, are situated flush with the corresponding front and rear edges (34) of the recessed portions (33) in the base plate (21) receiving the lower ends of the coil springs, and the gables (19, 20) have a thickness which is smaller than the diameter of the coil springs and have reinforcing portions (31, 32) directed inwards in the machine and forming engagement surfaces (29) for the upper ends of the coil springs.

* * * * *